United States Patent [19]

Gaskell et al.

[11] 4,030,061

[45] June 14, 1977

[54] ELECTRICAL WIRE CUTTING CIRCUIT BREAKER

[75] Inventors: Clifford R. Gaskell, Richfield; Stephen E. Houghland, Maplewood, both of Minn.

[73] Assignee: Minnesota Mining and Manufacturing Company, St. Paul, Minn.

[22] Filed: Apr. 14, 1976

[21] Appl. No.: 676,695

[52] U.S. Cl. ..... 337/409; 83/580; 200/61.08; 361/103

[51] Int. Cl.[2] ..... H01H 37/76; H01H 71/20

[58] Field of Search ..... 337/6, 52, 148, 405, 337/407–409, 62, 64; 200/60.08; 83/580, 592, 639, 686; 317/40 A, 57, 58; 318/471

[56] References Cited

UNITED STATES PATENTS

| | | | |
|---|---|---|---|
| 2,747,667 | 5/1956 | Schaming | 83/580 X |
| 3,003,045 | 10/1961 | Tichenor | 200/61.08 |
| 3,155,800 | 11/1964 | Denton | 337/409 |

*Primary Examiner*—Robert J. Hickey
*Attorney, Agent, or Firm*—Cruzan Alexander; Donald M. Sell; Terryl K. Qualey

[57] ABSTRACT

An electrical wire cutting circuit breaker in which a wire cutting piston within a housing moves from a rest position to a wire cutting position under the impetus of a compression spring. The piston is normally retained in its rest position against the force of the compression spring by a retainer held in the path of the piston by a fusible stop. The retainer is resiliently biased out of the path of the piston so that when the fusible stop melts and flows at a predetermined elevated temperature the retainer will release the piston which is propelled by the compression spring and builds up kinetic energy sufficient to cut an electrical wire.

9 Claims, 5 Drawing Figures

ELECTRICAL WIRE CUTTING CIRCUIT BREAKER

FIELD OF THE INVENTION

The present invention relates to a circuit breaker in which an electrical wire is physically severed to interrupt the circuit.

BACKGROUND OF THE INVENTION

The prior art includes devices, such as fire alarms, in which a fusible material melts at an elevated temperature and releases a spring-propelled piston which moves to close an electrical circuit. Such devices are disclosed in U.S. Pat. Nos. 487,519; 821,098; 1,552,105 and 1,685,136. Those structures are not, however, suitable to sever an electrical wire to open the electrical circuit because as the fusible material melts the spring urges the piston to creep toward its closed position. The piston thus slowly moves to its closed position. This is adequate to close an electrical circuit but it does not provide sufficient force to sever a wire to open an electrical circuit.

Devices for severing an electrical wire or the like utilizing a propelled cutting piston are disclosed in U.S. Pat. Nos. 3,003,045; 3,246,396; and 3,640,169. The latter two patents, which disclose means for propelling the cutting piston, utilize an explosive charge to supply sufficient energy to the piston to sever the wire.

SUMMARY OF THE INVENTION

The present invention provides an electrical wire cutting circuit breaker including a housing formed with an electrical wire receiving aperture therethrough and a wire cutting piston within the housing with its axis at an angle to the axis of the wire receiving aperture. The piston is axially movable from a rest position to a wire cutting position and compression spring is positioned within the housing to propel the piston from its rest position to its wire cutting position. A piston retainer is movable into the path of the piston to retain it in its rest position against the compression spring and is resiliently biased out of the path of the piston, and a thermally activatable stop is positioned within the housing to retain the piston retainer in the path of the piston at normal temperatures and to flow at a predetermined elevated temperature to permit the piston retainer to move out of the path of the piston. A cutter is provided for severing the wire in the wire receiving aperture by the kinetic energy of the piston upon its release from its rest position by the piston retainer and propulsion by the compression spring to its wire cutting position.

The thermally activatable material thus does not directly restrain the spring loaded piston but instead restrains the piston retainer which blocks the path of movement of the piston. Movement of the thermally activatable material at the predetermined elevated temperature permits the resiliently biased piston retainer to move out of the path of the piston to instantaneously release the piston from its rest position. This permits the piston to build up sufficient kinetic energy as it moves from its rest position to its wire cutting position to sever the wire.

THE DRAWING

Figure 1:
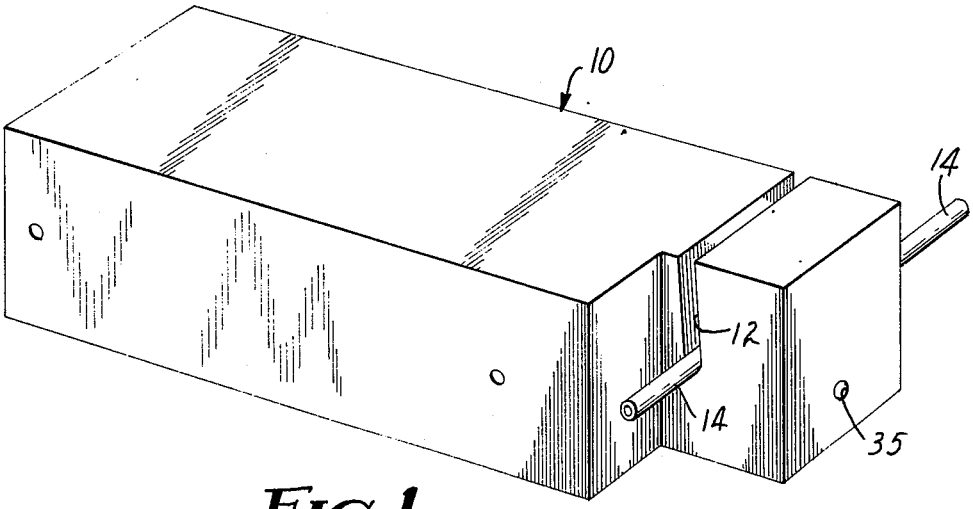
FIG. 1 is a perspective view of an electrical wire cutting circuit breaker constructed in accordance with the present invention.
Figure 4:
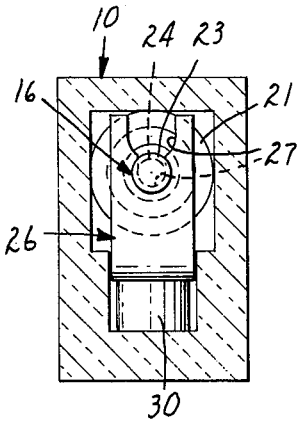
FIG. 4 is a cross-sectional view taken along line 4—4 of FIG. 2.
Figure 5:
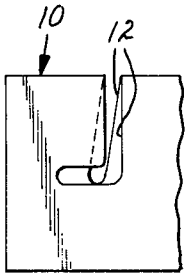
FIG. 5 is an elevation view of a portion of the edge wall of the circuit breaker hidden in FIG. 1.
Figure 3:
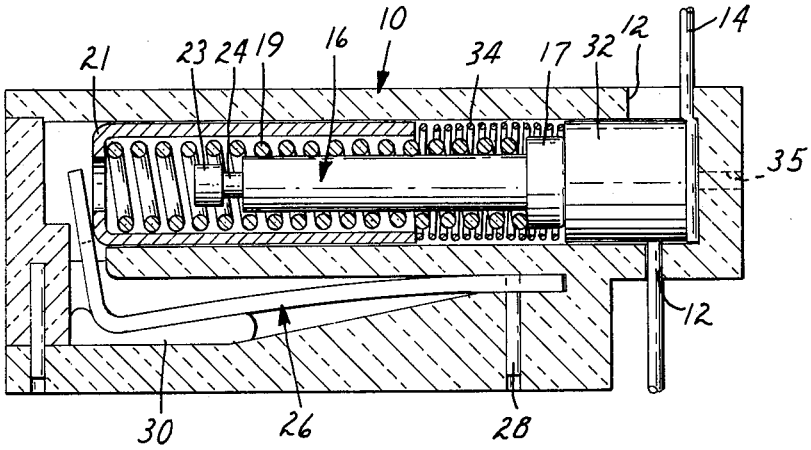
FIG. 3 is a view similar to FIG. 2 showing the position of the parts after a wire has been severed.

The electrical wire cutting circuit breaker of the present invention includes an insulating housing 10 formed with an electrical wire-receiving aperture therethrough. In the illustrated embodiment the wire receiving aperture forms the end of a wire receiving slot 12 formed in the housing 10 so that a central portion of a long length of electrical wire 14 can be directly placed in the wire receiving aperture. The slot 12 at the edge wall of the housing 10 seen in FIG. 1 is straight whereas at the opposing edge wall seen in FIG. 5 it is L-shaped for a purpose which will be hereinafter described.

A wire cutting piston 16 is positioned within the housing 10 with its axis at an angle to the axis of the wire receiving aperture. The piston 16 is formed at one end with a head 17 followed by a smaller diameter body portion around which is coiled a compression spring 19. The compression spring 19 and a major portion of the piston 16 are normally surrounded by a spring retainer sleeve 21 which has a reduced diameter at its rearward end to trap the compression spring 19 between the reduced diameter of the sleeve 21 and the piston head 17. The piston 16 is formed in its rearward end with a larger diameter end 23 followed by a reduced diameter portion 24, the larger diameter portion being smaller than the body of the piston so as to pass freely through the reduced opening in the spring retainer sleeve 21.

Figure 2:
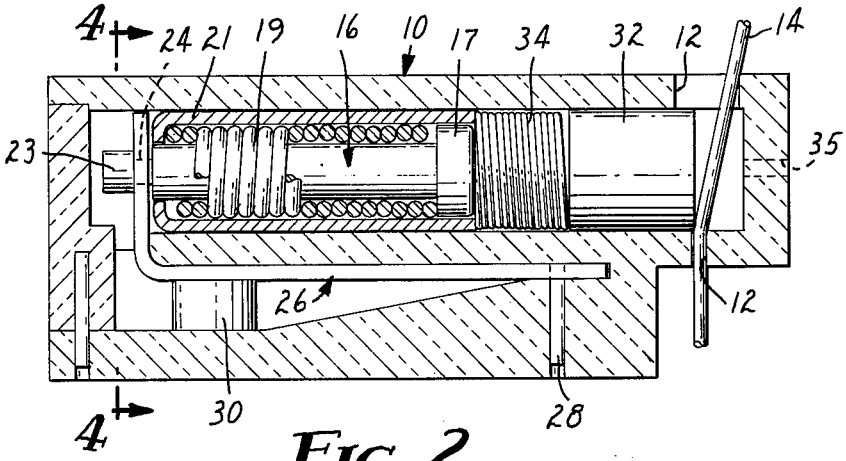
FIG. 2 is a longitudinal, cross-sectional view removing the top of the housing to expose the internal parts.

An L-shaped leaf spring 26 is positioned in the housing 10 with one leg perpendicular to the axis of the piston 16 and one leg parallel thereto. The leg of the leaf spring 26 perpendicular to the axis of the piston 16 is formed adjacent its end with the keyhole slot 27. The reduced diameter of the keyhole slot 27 normally fits around the reduced diameter portion 24 of the piston 16. The face of the leaf spring leg then engages the larger diameter end 23 to retain the piston 16 in its rest position illustrated in FIG. 2 against the force of the compression spring 19. The larger diameter of the keyhole slot 27 is formed to permit passage therethrough of the larger diameter end 23 of the piston 16.

The leaf spring 26 is held in place in the housing by a pin 28 through the leg thereof which is parallel to the axis of the piston 16. The leg of the leaf spring 26 which is parallel to the axis of the piston 16 is curved in an unstressed condition and it is resiliently stressed into the normal position illustrated in FIG. 2 during assembly of the device. The leaf spring is retained in the normal stressed position illustrated in FIG. 2 by a thermally activatable stop 30 of a fusible material. The stop 30 is preferably a eutectic material which melts at a precise predetermined elevated temperature to permit the leaf spring 26 to move out of the path of the piston 16 allowing the larger diameter end portion 23 of the piston to pass through the larger diameter portion of the keyhole slot 27 in the end of the leaf spring 26. The release of the piston 16 by the leaf spring 26 is instantaneous permitting the compression spring 19 to freely accelerate the piston 16 from its rest position to a cutting position to build up kinetic energy in the piston for the cutting operation. This is very important, since without the buildup of kinetic energy it would require a prohibitively large device to cut an electrical wire.

A right cylindrical ceramic cutting pellet 32 is positioned coaxially with the piston, between the piston 16 and the wire receiving slot 12 to be impacted by the piston head 17 to sever the wire 14. The travel of the piston 16 from its rest position illustrated in FIG. 2 until it reaches its cutting position in contact with the ceramic pellet 32 is the distance over which the piston 16 gains the kinetic energy necessary to sever the wire 14.

The straight edge of wire-receiving slot 12 in the edge wall of the housing 10 seen in FIG. 1 is inclined to the axis of the piston 16 progressing from the top wall of the housing toward the front of the housing. The L-shaped edge of slot 12 in the edge wall of the housing 10 seen in FIG. 5 has one leg extending from the top wall of the housing perpendicular to the axis of the piston 16 and its other leg extending toward the front of the housing parallel to the piston axis and terminating closer to the forward wall of the housing than the straight slot (see FIG. 2). The wire receiving aperture through the housing 10 formed by the end of the wire receiving slot 12 (i.e. the connected ends of the straight edge portion and the L-shaped edge portion, as connected by the wire 14 in FIG. 2) is thus at an angle to the axis of the piston 16 slightly less than 90°.

The forward planar cutting surface of the ceramic cutting pellet 32 is thus required to sever only one wire end to break the electrical circuit whereas if the piston axis-wire receiving aperture angle is 90° the ceramic pellet 32 must cut the wire ends at both edges of the housing 10, requiring about twice the kinetic energy.

A second compression spring 34 having an internal diameter larger than the diameter of the piston head 17 is trapped between the spring retainer sleeve 21 and the ceramic pellet 32 to urge the ceramic pellet 32 away from the piston 16 and toward the front of the housing 10. An aperture 35 in the front wall of the housing 10 provides access for insertion of a rod to push the ceramic pellet 32 against compression spring 34 to permit insertion of a wire 14 into the wire receiving slot 12. Upon insertion of the wire 14 and the release of the ceramic pellet 32, the compression spring 34 urges the ceramic pellet 32 against the wire 14. Due to the rearward incline of the wire receiving slot 12 in the edge wall of the housing 10 seen in FIG. 1 and the L-shape thereof in the edge wall seen in FIG. 5, the cylindrical ceramic pellet 32 presses against the wire 14 and blocks the remainder of the wire receiving slot 12 to retain the wire in the slot.

The wire 14 may, for example, be the magnet wire winding of an electric motor. The fusible stop 30 is then chosen to melt at a temperature indicating failure of the motor. Melting of the fusible stop 30 releases the leaf spring 26 which resiliently biases its end with the keyhole slot 27 out of the path of the larger diameter end 23 of the piston 16. The compression spring 19 then propels the piston 16 axially from its rest position illustrated in FIG. 2 to its wire cutting position at which the piston head 17 impacts the ceramic pellet 32, the travel of the piston building up sufficient kinetic energy to force the ceramic pellet 32 to sever the wire 14. Space is provided in the housing 10 beyond the cutting position of the ceramic pellet 32 to permit the piston to move beyond its cutting position to carry the ceramic pellet 32 and the severed wire end therewith away from the remaining wire end to assure that the electrical circuit is interrupted. In the final position, the insulating ceramic pellet 32 blocks the wire receiving aperture to assure that there is no possible electrical path through the housing 10.

In one specific embodiment an electrical wire cutting circuit breaker was constructed in accordance with the present invention to sever magnet wire having a maximum diameter of 0.323 millimeter. The fusible stop 30 was a binary eutectic consisting of 58% bismuth and 42% tin and having a melting point of 140° C. The movement of the piston 16 from its rest position illustrated in FIG. 2 to its cutting position in contact with the ceramic pellet 32 was 3.81 millimeters. The compression spring 19 had a free length of 18.1 millimeters and a compressed length of 9.65 millimeters with a load of 0.6 kilogram at 15.7 millimeters and a load of 1.2 kilograms at 13.3 millimeters. The spring 19 had an outside diameter of 3.1 millimeters with 16 active coils and 18 total coils, the spring material being 0.5 millimeter 17–7 PH stainless steel.

We claim:

1. An electrical wire cutting circuit breaker comprising:

a housing formed with an electrical wire receiving aperture therethrough, a wire cutting piston within said housing with its axis at an angle to the axis of said wire receiving aperture, said piston being axially movable from a rest position to a wire cutting position.

a compression spring positioned within said housing to propel said piston from said rest position to said wire cutting position, retainer means movable into the path of said piston to retain it in said rest position against said compression spring, said retainer means being resiliently biased out of the path of said piston, a thermally activatable stop positioned within said housing to retain said retainer means in the path of said piston at normal temperatures and to move at a predetermined elevated temperature to permit said retainer means to move out of the path of said piston, and cutting means for severing a wire in said wire receiving aperture by the kinetic energy of said piston upon its release from said rest position by said retainer means and propulsion by said compression spring to said wire cutting position.

2. The circuit breaker of claim 1 wherein said cutting means has a planar cutting surface perpendicular to the axis of said piston and wherein the axis of said piston is at an angle less than 90° to the axis of said wire receiving aperture, whereby said cutting surfaces severs only one end of a wire in said wire receiving aperture upon propulsion by said piston.

3. The circuit breaker of claim 1 wherein said cutting means comprises a cutting pellet positioned between said wire cutting piston and said wire receiving aperture, said cutting pellet having a lesser length than the distance between said piston in its rest position and said wire receiving aperture, whereby upon release of said piston it will build up kinetic energy prior to propelling said cutting pellet against a wire in said wire receiving aperture to sever the wire.

4. The circuit breaker of claim 3 wherein said cutting pellet is formed of an insulating material and said piston is movable beyond said wire cutting position to carry said cutting pellet and a severed wire therewith away from said wire receiving aperture to assure breaking of the electrical connection.

5. The circuit breaker of claim 1 wherein said wire receiving aperture forms the end of a wire receiving slot in said housing to receive a central portion of a wire.

6. The circuit breaker of claim 5 wherein said cutting means comprises a cutting pellet positioned between said wire cutting piston and said wire receiving aperture, said cutting pellet having a lesser length than the distance between said piston in its rest position and said wire receiving aperture, whereby upon release of said piston it will build up kinetic energy prior to propelling said cutting pellet against a wire in said wire receiving aperture to sever the wire.

7. The circuit breaker of claim 6 wherein said cutting pellet has a planar cutting surface perpendicular to the axis of said piston and wherein the axis of said piston is at an angle less than 90° to the axis of said wire receiving aperture, whereby said cutting pellet severs only one end of a wire in said wire receiving aperture upon propulsion by said piston.

8. The circuit breaker of claim 6 including a second compression spring to urge said ceramic pellet against a wire in said wire receiving slot thereby to retain the wire in the slot.

9. The circuit breaker of claim 1 wherein the rearward end of said wire cutting piston in formed with a larger diameter end followed by a reduced diameter portion, and wherein said retainer means comprises an L-shaped leaf spring positioned with one leg perpendicular to the axis of said piston and one leg parallel thereto, the perpendicular leg being formed adjacent its end with a keyhole slot to fit around the reduced diameter portion of said piston and engage the larger diameter end thereof while said leaf spring is retained by said fusible stop and to move the keyhole slot to permit the larger diameter end to pass by when said leaf spring is released by said fusible stop.

* * * * *